US010098436B2

(12) United States Patent
Bonnin et al.

(10) Patent No.: US 10,098,436 B2
(45) Date of Patent: Oct. 16, 2018

(54) ASSEMBLY FOR CONTAINER OF COSMETIC PRODUCT AND CONTAINER COMPRISING SUCH AN ASSEMBLY

(71) Applicant: Albea Services, Gennevilliers (FR)

(72) Inventors: Thomas Bonnin, Pronleroy (FR); Frederic Lecureuil, Neuville sur Sarthe (FR)

(73) Assignee: ALBEA SERVICES, Gennevilliers (FR)

( * ) Notice: Subject to any disclaimer, the term of this patent is extended or adjusted under 35 U.S.C. 154(b) by 21 days.

(21) Appl. No.: 15/223,124

(22) Filed: Jul. 29, 2016

(65) Prior Publication Data

US 2017/0035182 A1 Feb. 9, 2017

(30) Foreign Application Priority Data

Aug. 4, 2015 (FR) ..... 15 57522

(51) Int. Cl.
*A45D 40/10* (2006.01)
*A45D 40/06* (2006.01)

(52) U.S. Cl.
CPC ..... *A45D 40/10* (2013.01); *A45D 40/06* (2013.01)

(58) Field of Classification Search
CPC ..... A45D 40/10
USPC ..... 401/55, 81
See application file for complete search history.

(56) References Cited

U.S. PATENT DOCUMENTS 3,771,881 A * 11/1973 Swenson ..... A45D 40/04 401/68
5,102,249 A * 4/1992 Holloway ..... A45D 40/10 401/116
5,934,815 A 8/1999 Hurlburt

FOREIGN PATENT DOCUMENTS

EP 0439381 A1 7/1991
FR 2797158 A1 2/2001

OTHER PUBLICATIONS

Jun. 8, 2016—(FR) Search Report—App 1557522.

* cited by examiner

*Primary Examiner* — David Walczak
*Assistant Examiner* — Joshua Wiljanen
(74) *Attorney, Agent, or Firm* — Banner & Witcoff, Ltd.

(57) ABSTRACT

An assembly for a container 1 of cosmetic product has a cup support 30 and a cup 10. The cup 10 is configured to receive the cosmetic product. The cup 10 and the cup support 30 are interconnected by a spring connection 20. A container 1 for cosmetic product has such an assembly.

12 Claims, 4 Drawing Sheets

ASSEMBLY FOR CONTAINER OF COSMETIC PRODUCT AND CONTAINER COMPRISING SUCH AN ASSEMBLY

CROSS-REFERENCE TO RELATED APPLICATIONS

The present application claims priority to French Patent Application No. 1557522 filed Aug. 4, 2015. The present application claims priority to and the benefit the above-identified application, which is incorporated by reference herein in its entirety.

FIELD OF THE INVENTION

The invention relates to the field of containers for cosmetic product, in particular for sticks of cosmetic product. The invention can be applied in particular to containers for sticks of lipstick.

BACKGROUND

There exist containers for cosmetic product comprising a main body and a cup receiving the cosmetic product, for example in the form of a stick of cosmetic product. The cup is movable relative to the main body and can be moved, in particular in translation, between a retracted position inside the main body and a non-retracted position configured to allow the cosmetic product to be used.

However, because of their fragility, sticks of cosmetic product are sometimes damaged either when they are fitted to the cup or during application of make-up. This is because, during these two phases in particular, the force produced by a sudden movement exerted by the cup on the stick can lead to the deformation or breakage of the stick of cosmetic product.

SUMMARY

There is therefore a need to improve this technology. To do this, the invention proposes an assembly for a cosmetic product container, said assembly comprising a cup support and a cup, the cup being configured to receive the cosmetic product, the cup and the cup support being interconnected by a spring connection.

The spring connection between the cup and the cup support performs a damping function between these two components. In this way, the fitting of the cosmetic product into the cup is facilitated. Likewise, the spring connection enables any tremors or sudden movements by the user during application of make-up to be absorbed, said spring connection deforming when a force is applied to the cosmetic product.

According to different embodiments, which can be taken together or separately:

- said cup and said cup support are mutually configured so that the cup is driven by the cup support;
- the cup and the cup support are movable in translation relative to one another;
- the cup and the cup support are to one another for conjoint rotary movement;
- one of the cup and the cup support is provided with a protrusion, the other of the cup and the cup support is provided with a guide, the protrusion and the guide being designed to cooperate with one another so as to allow the cup to slide relative to the cup support;
- said assembly comprises a spring;

- said spring is designed to be arranged between the cup and the cup support;
- said spring is a helical spring;
- said assembly comprises flexible legs;
- the spring connection is provided by said spring and/or by the flexible legs;
- the cup is intended to receive a stick of the cosmetic product;
- the cup support and the cup each comprise a bottom and said spring connection bears against each of said bottoms;
- the cup is movable inside the cup support.

The invention also relates to a container for cosmetic product comprising an assembly as described above. According to different embodiments, which can be taken together or separately:

- the container further comprises a first body, the cup support being movable relative to said first body;
- the container further comprises a second body, mounted in rotation relative to the first body, a rotation of the first body relative to the second body causing the cup support to move;
- one of the first and second bodies is provided with an axial guide, the other of said first and second bodies is provided with a helical guide, the cup support being provided with a protrusion intended to cooperate simultaneously with both the axial guide and the helical guide.

BRIEF DESCRIPTION OF THE DRAWINGS

The invention will be better understood, and its other aims, details, features and advantages will become more clearly apparent from the following detailed explanatory description of at least one embodiment of the invention given as a purely illustrative and non-restrictive example, with reference to the accompanying schematic drawings.

DETAILED DESCRIPTION OF EXEMPLARY ASPECTS

Figure 1:
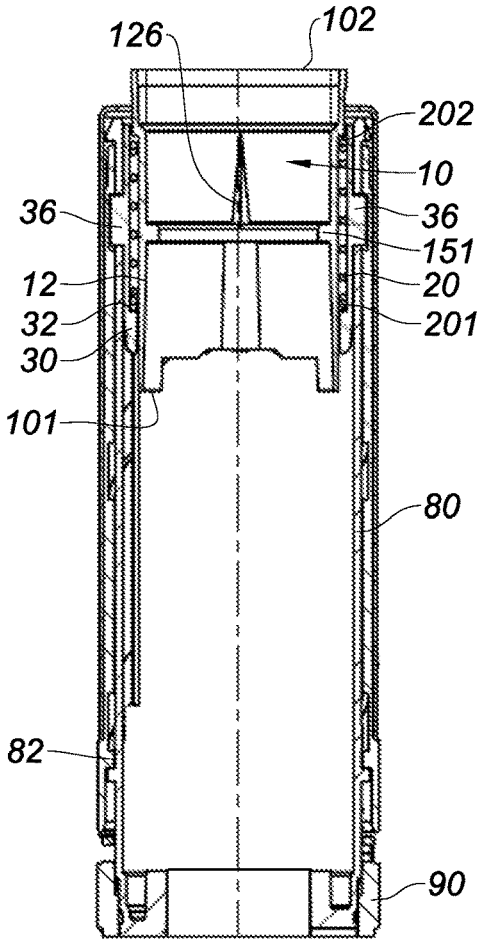
FIG. 1 is a longitudinal section of a container for cosmetic product according to a first embodiment according to the invention.

As shown in FIGS. 1 to 4, the invention relates to an assembly for a container 1 of cosmetic product. The invention also relates to an assembly for said container 1, said assembly comprising a cup support 30 and a cup 10.

Said cosmetic product is in particular in the form of a stick of cosmetic product. It can for example be a stick of lipstick.

Said container 1 is in particular designed to allow the stick of cosmetic product, not shown, to emerge from the container 1 so that the user can use said product. Likewise, said container 1 is advantageously configured so as to allow said cosmetic product to retract into said container 1 so that the product is protected.

Said container 1 here comprises a first body 80 and a second body 82.

Advantageously, said first body 80 is designed to be mounted in rotation relative to said second body 82, said first body 80 being for example designed to be arranged, at least partially, in an interior space of said second body 82.

It is observed that the cup support 30 is designed to be fitted in an interior space of said first body 80 in such a way that the cup support 30 is arranged in engagement with the first body 80, while being movable in translation relative thereto in a longitudinal main direction of extension of said first body 80. In other words, the first body 80 and the cup support 30 are interconnected by a sliding connection.

Said first body 80 is here provided with a lower end and an upper end and extends in its longitudinal main direction of extension between said lower and upper ends. Said first body 80 advantageously comprises a lateral wall which extends in said longitudinal main direction of extension between said lower and upper ends.

Likewise, said second body 82 is advantageously provided with a lower end and an upper end and extends in a longitudinal main direction of extension between said lower and upper ends. Said second body 82 here comprises a lateral wall that extends in said longitudinal main direction of extension between said lower and upper ends.

Once fitted inside one another, the first body 80 and the second body 82 are designed so that their respective longitudinal main directions of extension are coincident with an axis of rotation of the first body 80 and the second body 82 relative to one another.

Said first body 80 is for example provided on its lateral wall with at least one longitudinal slot or longitudinal guide. Said longitudinal slot is arranged between said lower and upper ends of said first body 80. Advantageously, said longitudinal slot is substantially rectilinear. It therefore extends in a direction parallel to the longitudinal main direction of extension of said first body 80.

Said first body 80 can be provided at its lower end with a gripping zone 90, in particular a ring, intended to allow, through manipulation thereof, the first body 80 to rotate relative to the second body 82.

Advantageously, said second body 82 is provided with a helical groove or helical guide. Said helical groove is arranged on an internal surface of the lateral wall of said second body 82 between its lower and upper ends. In other words, the helical groove is shaped as a spiral that extends along the length of the lateral wall of the second body 82. It is able here to act as an indentation or as a rail designed on the internal surface of the lateral wall of the second body 82. It will be observed that, advantageously, in particular for aesthetic reasons, said second body 82 can be covered by an envelope serving as the outer covering of the container.

The helical groove and the longitudinal slot of the first body 80 and the second body 82 are advantageously substantially identical in height.

The cup 10 is configured to receive said stick of cosmetic product. The cup 10 is here designed so as to be used as a support to said stick of cosmetic product. The cup 10 is furthermore designed to be arranged in the cup support 30. Advantageously, the cup 10 and said cup support 30 are mutually designed so that the cup 10 is driven by the cup support 30.

The cup 10 advantageously comprises a lateral wall 12 substantially cylindrical in shape. Said wall 12 comprises a lower end 101 and an upper end 102 and extends in an axial direction between said lower end 101 and said upper end 102.

Figure 2:
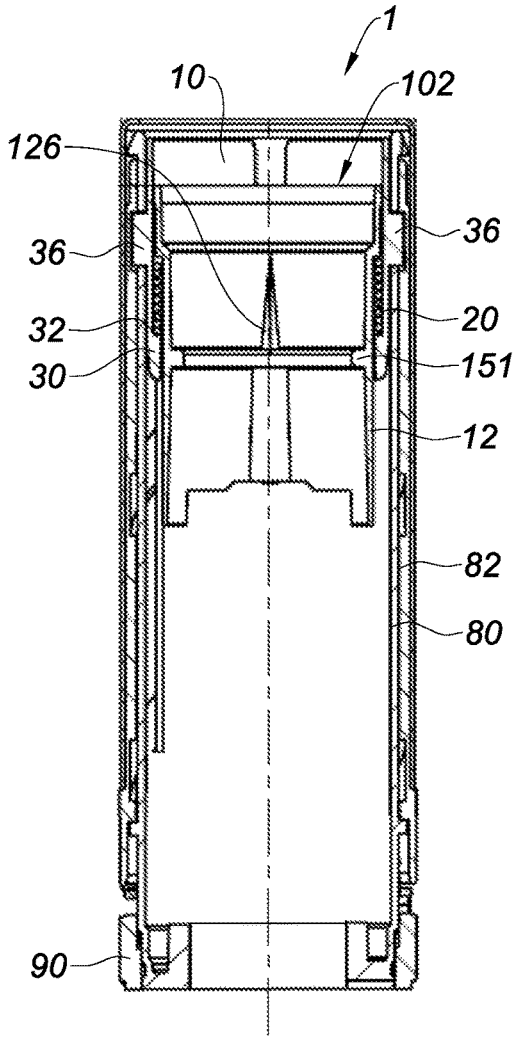
FIG. 2 is a longitudinal section of the container shown in FIG. 1, the container then being in another configuration.
Figure 3:
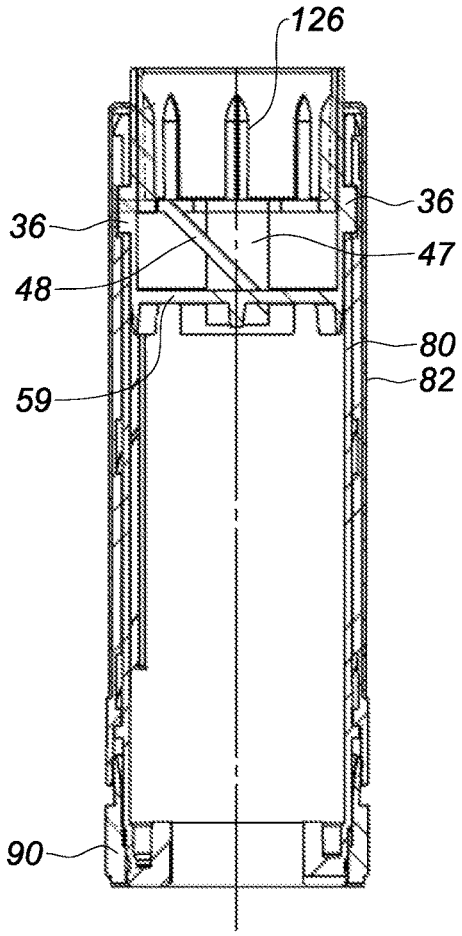
FIG. 3 is a longitudinal section of the container for cosmetic product according to a second embodiment, according to the invention.
Figure 4:
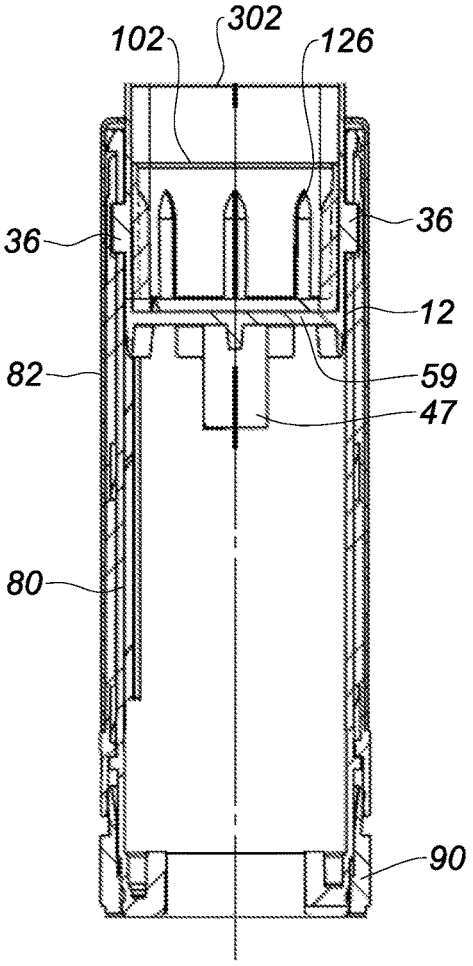
FIG. 4 is a longitudinal section of the container shown in FIG. 3, said container then being in another configuration.

According to a first embodiment, the cup 10 advantageously comprises an internal shoulder or ring 151 that can be seen in FIGS. 1 and 2. "Internal shoulder" means a sudden change in an internal diameter of the lateral wall 12 of the cup 10. Said internal shoulder 151 can be used as an internal bearing surface for the stick of cosmetic product. In other words, said internal shoulder 151 is configured to be used as an axial stop for the cosmetic product. In other words, the internal shoulder 151 is configured to help hold the stick of cosmetic product. It will be observed that said internal shoulder 151 is situated in a median plane between the lower end 101 and the upper end 102 of the cup 10.

An internal surface of the lateral wall 12 of the cup 10 can furthermore be provided with vertical ribs 126, said ribs 126 having a longitudinal shape and extending longitudinally parallel to the axial direction of the cup 10. Said ribs 126 can for example extend from the internal shoulder 151 of the lateral wall 12. They are designed to help hold the stick of cosmetic product inside the cup 10. It will be observed that the ribs 156 here have a tapered shape. In other words, the ribs 156 have a dimension, known as width, measured perpendicularly to their longitudinal direction of extension, that diminishes with proximity to the upper end 102 of the cup 10.

Figure 5:
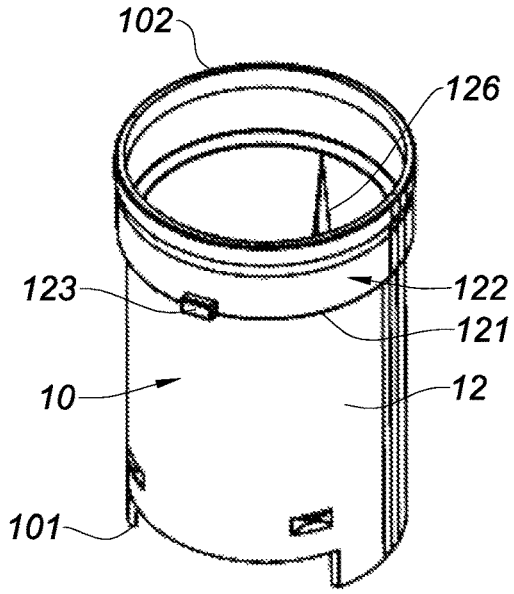
FIGS. 5 to 7 are perspective views of a cup, a spring and a cup support according to an embodiment of the container assembly according to the invention.
Figure 6:
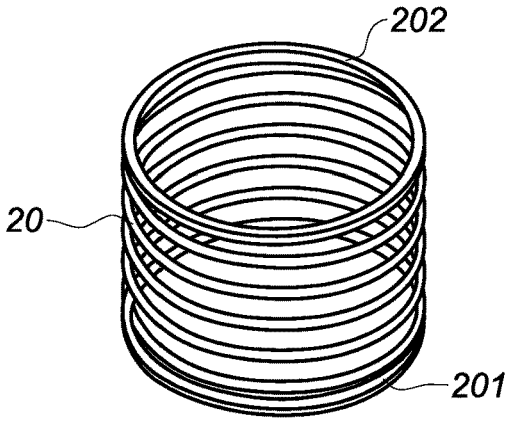
Figure 7:
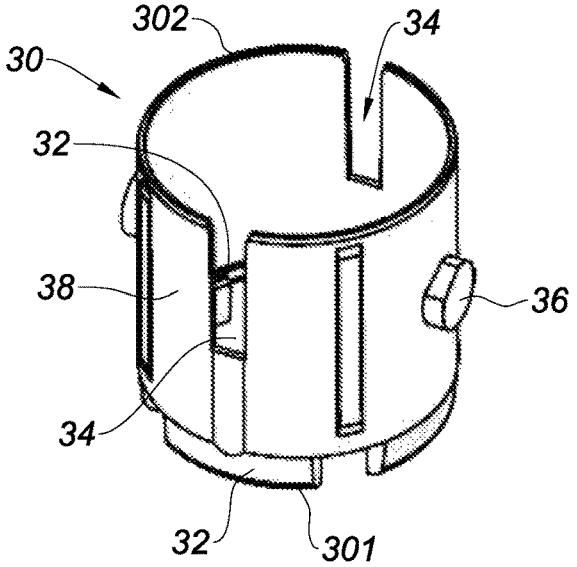
Figure 8:
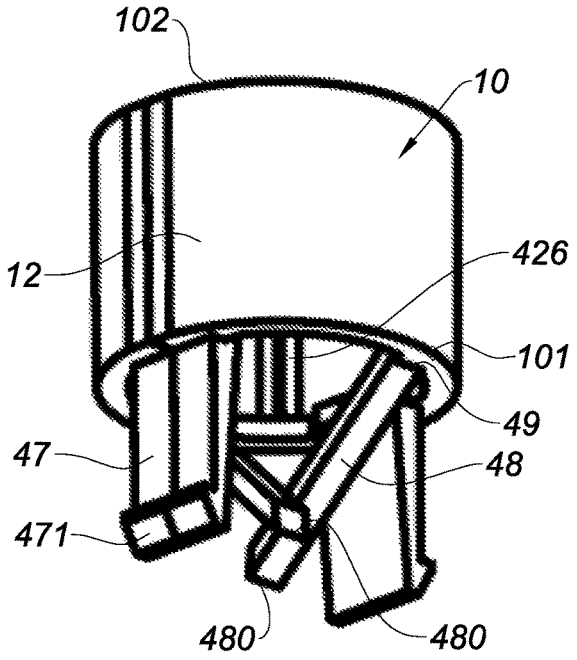
FIGS. 8 and 9 are a perspective view of a cup and a cup support according to a variant of the container assembly according to the invention.

As shown in FIG. 5, the lateral wall 12 is provided on its external surface with an external shoulder 122. Said external shoulder 122 here corresponds to a sudden widening of an external diameter of the lateral wall 12. Said external shoulder 122 here has a lower end 121 and an upper end 102 and extends axially, that is, in said axial direction of the cup 10, between said lower end 121 and said upper end 102. It will be observed that, advantageously, the upper end 102 of the external shoulder 122 corresponds to the upper end 102 of the lateral wall 12.

Said external shoulder 122 is itself provided with pins or protrusions 123, here two pins 123, substantially rectangular in shape. They are arranged at the lower end 121 of the external shoulder 122 or close thereto. Advantageously, they project radially towards the space outside the cup 10. Said pins 123 are here distributed at regular angular intervals around said external shoulder 122. In other words, in this instance, the two pins 123 are diametrically opposite one another.

It will be observed that the external shoulder 122 forms at its lower end 121 an external bearing surface. Said external bearing surface is here plane and perpendicular to the axial direction of the cup 10.

In order to understand more clearly the manner in which the cup 10 and the cup support 30 fit together, it can be observed that the lateral wall 12 of the cup 10 has a first external diameter between its lower end 101 and the lower end 121 of the external shoulder 122 and a second external diameter measured at the external shoulder 122 of the wall 12, the first external diameter being smaller than the second external diameter.

The cup support 30 is designed to receive the cup 10. The cup support 30 is furthermore designed to drive the cup 10 between a retracted position, allowing the container 1 to be closed, and a high position corresponding to a use position. The cup support 30 here has a lower end 301 and an upper end 302. Said cup support 30 advantageously comprises a lateral wall 38 substantially cylindrical in shape that extends in an axial direction of the cup support 30 between said lower end 301 and said upper end 302.

In the same embodiment as that shown in FIGS. 1, 2 and 5 to 7, said lateral wall 38 of the cup support is provided with at least one axial slot or axial guide 34, here two axial slots 34 diametrically opposite one another. Said axial slots 34 extend in the axial direction of the cup support 30 from the upper end 302 of the lateral wall 30 and over approximately half the height of said lateral wall 38, said height being measured parallel to said axial direction of the cup support 30.

The cup support 30 is designed to allow the cup 10 to slide axially in the interior space of the cup support 30. For that purpose, the pins 123 of the cup 10 are designed to cooperate mechanically with the axial slots 34 of the cup support 30. In particular, the pins 123 of the cup 10 are designed to engage in said axial slots 34 of the cup support 30 in such a way as to fix the cup 10 and the cup support 30 to one another for conjoint rotary movement.

It will be observed that, advantageously, when they are fitted inside one another, the respective axial directions of the cup support 30 and the cup 10 are coincident. In other words, the cup 10 and the cup support 30 are then coaxial.

The cup support 30 further comprises pins or protrusions 36, here two pins 36. Said pins 36 are for example substantially oblong in shape and are arranged on an external surface of the lateral wall 38 of the cup support 30. Said pins 36 project radially, towards the exterior of the cup support 30.

Furthermore, the cup support 30 is advantageously provided on the internal surface of its lateral wall with an interior ledge. Said interior ledge 32 there forms an internal bearing surface. Said internal bearing surface is advantageously plane and perpendicular to the axial direction of extension of the cup support 30. Advantageously, the interior ledge forms an axial stop. It is observed that said interior ledge 32 is arranged at the lower end 301 of the lateral wall of the cup support.

To better understand the manner in which the cup 10 and the cup support 30 fit together, it can be observed that the cup support 30 has a first internal diameter when located between the upper end of the lateral wall and the internal bearing surface of the interior ledge 32 and a second internal diameter when located at the internal ledge 32, said second internal diameter being smaller than said first internal diameter.

It will be observed that, advantageously, said second internal diameter of the cup support 30 is, allowing for play, equal to the first external diameter of the cup 10. The first internal diameter of the cup support 30 is itself, allowing for play, equal to the second external diameter of the cup 10.

Once the cup 10 has been fitted inside the cup support 30, the internal bearing surface of the cup support 30 and the external bearing surface of the cup 10 are designed to be arranged opposite one another, that is, so that they are facing.

According to the invention, the cup 10 and the cup support 30 are interconnected by a spring connection 20. Advantageously, the spring connection is designed to provide resistance, related to the rigidity of the spring connection, to an axial force exerted by the cup 10 on the cup support 30. This type of force can occur in particular during use of the container. In particular, the spring connection 20 is configured to provide resistance to a translation of the cup 10 relative to the cup support 30, said translation being parallel to a sliding direction of the cup 10 in the cup support 30, that is, parallel to an axial direction of the cup support 30. In other words, said spring connection 20 is here designed as a damper between the cup 10 and the cup support 30, which thus have a damping function.

Alternatively or additionally, said spring connection can be designed to provide resistance to a torsional force exerted by the cup 10 on the cup support 30. In other words, the spring connection 20 can be designed to block a rotation of the cup 10 relative to the cup support 30. In this instance, the spring connection can be provided by a spring in torsion.

In the embodiment shown in FIGS. 1, 2 and 5 to 7, said spring connection 20 is advantageously a spring 20, in particular a helical spring working for example in compression. Said spring 20 here consists of a metal spiral and has a substantially cylindrical overall shape. Said spring 20 advantageously comprises a lower end 201 and an upper end 202 and extends in an axial direction of the spring 20 between these two ends 201, 202. The spring 20 is here designed to be arranged between the cup 10 and the cup support 30.

The spring 20 is designed to be disposed axially between the lower end 121 of the external shoulder 122 of the cup 10 and the internal ledge 32 of the cup support 30. More precisely, said spring 20 is designed to coil around the wall 12 of the cup 10. In other words, it is disposed firstly between the external surface of the cup 10 and the internal surface of the cup support 30 and secondly between the external bearing surface of the cup 10 and the internal bearing surface of the cup support 30. Thus, the spring 20 is arranged in a housing situated between the cup 10 and the cup support 30.

The respective axial directions of the spring 20, the cup support 30 and the cup 10 are here coincident. In other words, the spring 20, the cup support 30 and the cup 10 are designed to be fitted coaxially in relation to one another.

Said spring 20 is capable of being compressed in its axial direction. It extends axially over a height, measured parallel to the axial direction of the spring 20, that varies according to the intensity of compression of the spring 20.

More precisely, the upper end 202 of the spring 20 is designed to be arranged so that it is in contact with the external bearing surface of the cup 10, whereas the lower end of the spring 20 is designed to be arranged so that it is in contact with the internal bearing surface of the cup support 30. It is observed that the upper end 202 of the spring 20 can for example be fixed to the external shoulder 122 so as to prevent the cup 10 from becoming dissociated from the cup support 30.

FIGS. 3, 4, 8 and 9 show a second embodiment. In this embodiment, the spring connection 20 is provided by flexible legs 48, here two flexible legs 48, which are configured to abut and/or rest axially on a bottom 59 of the cup support 52.

Said flexible legs 48 are here arranged at the lower end 101 of the cup 10. The flexible legs 48 are connected to the lateral wall of the cup by a joint or hinge 49. Said flexible legs 48 extend longitudinally from said hinge 49 to a free end 480 of the flexible legs 48.

Here, the two strips 48 are diametrically opposite and oriented towards one another. More particularly, it will be observed that said flexible legs are adjacent to one another.

Said flexible legs 48 are capable of pivoting through rotation about said hinge 49 when the cup 10 is subjected to an axial force. In particular, the rotation of each flexible leg 48 is produced by a localised elastic deformation at the hinge 49. In other words, the hinge 49 is here equivalent to a torsion spring between the lateral wall 12 of the cup 10 and the flexible leg 48. It will be observed that said rotation of the flexible legs 48 takes place between a rest position, shown in FIGS. 3 and 8, and an extreme position of said flexible legs 48, shown in FIG. 9.

The free ends 480 of the flexible legs 48 are designed to be in contact with the bottom 59 of the cup support 30. An axial movement of the cup 10 relative to the cup support 30 causes an angular movement of said free ends 480.

In the rest position, the flexible legs 48 are arranged in an axial extension of the interior space of the cup 10. Still in this rest position, they advantageously form an angle included in the range between 0 and 90°, here approximately 45 degrees, with a plane orthogonal to the axial direction of extension of the lateral wall of the cup 10. In other words, they are oriented transversely to the axial direction of the cup 10. Here, said flexible legs 48 cross one another, in particular near their free end.

It will be further observed that the extreme position is reached when the flexible legs 48 are oriented parallel to a plane perpendicular to the axial direction of the cup. In other words, when said flexible legs 48 are in said extreme position, the lower end 101 of the cup 10 and the free end 480 of said flexible leg 48 are designed to be situated substantially in the same plane, said plane being perpendicular to the axial direction of the cup 10.

In a manner similar to the helical spring described above in the first embodiment, said flexible legs 48 are therefore designed to act as a damper between the cup 10 and the cup support 30. In particular, said flexible legs 48 are designed to block a movement in translation of the cup relative to the cup support, said translation taking place in the axial direction of the cup support 30.

This being the case, in this embodiment, the cup 10 also differs from the previous embodiment in that the lateral wall 12 of the cup 10 is provided with rigid strips 47, here two rigid strips 47. Said rigid strips 47 are here arranged at the lower end 101 of the cup 10 and are diametrically opposite one another. They project in the axial direction of the cup 10 from the lower end 101 thereof.

Figure 9:
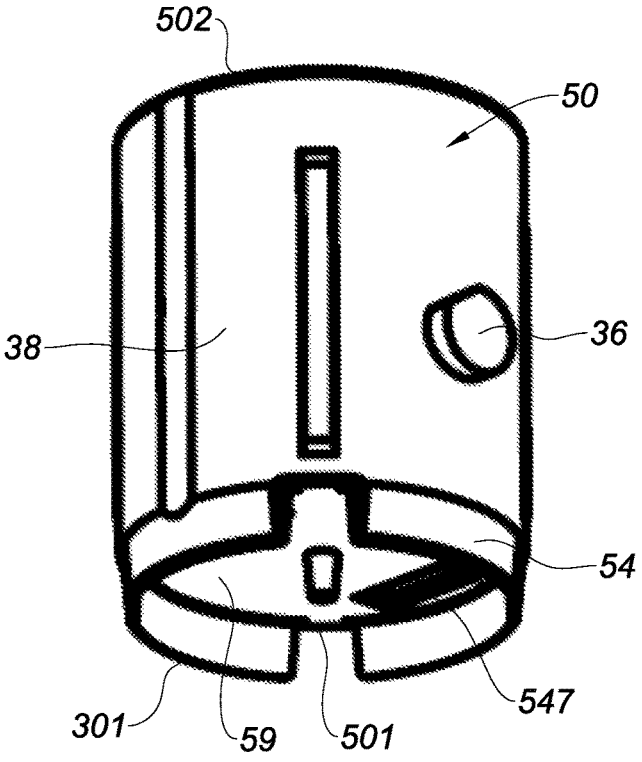

The cup support 30, shown in FIG. 9, differs from the cup support of the first embodiment in that it advantageously comprises the bottom 59 at the lower end of the lateral wall 38. Said bottom 59 of the cup support 30 can comprise passage slits 547, here two passage slits 547. Each passage slit 547 is provided to allow the passage of one of the rigid strips 47 of the cup 10 so as to allow said rigid strips 47 to engage in, or be guided into, the slits 547. Advantageously, said rigid strips 47 of the cup 10 are provided at their free end with a protrusion or excrescence 471. This protrusion 471 allows the rigid strips 47 to enter the slits 547 by elastic deformation and/or snap-fitting. Once the protrusions 471 of the rigid strips 47 have been inserted in the slits 547, said protrusions 471 act as axial stops and are configured to prevent the rigid strips 47 disengaging from said slits 547. The engagement of said rigid strips 47 in said slits 547 is provided so as to prevent the cup 10 from rotating relative to the cup support 30 and also to allow the cup 10 to slide in the interior space of the cup support 30.

It will be observed that as in the previous embodiment, the spring connection, here provided by the flexible legs 48 and their joint 480, is arranged between the cup 10 and the cup support 30.

It will be observed that said flexible legs 48 operate here as a spring operating in compression, presenting resistance to a movement of the cup 10 towards the cup support 30.

The pins 36 of the cup support 30 are configured to engage both in the helical groove of the second body 82 and in the longitudinal slot of the first body 80.

Once the cup 10 has been fitted in the cup support 30, the cup support 30 has been fitted in the first body 80 and the first body 80 has been fitted in the second body 82, rotation of the first body 80 relative to the second body 82 by the user allows an axial movement of the cup support 30 and therefore of the cup 10, parallel to the main directions of longitudinal extension of the first body 80 and the second body 82, said directions then being coincident. Said assembly according to the invention can in this way pass from a position, not shown, in which the product is retracted in the container, to a position, shown in FIGS. 1 to 4, in which the product is projecting, outside the container, this latter position corresponding also to the fitting position of the product in said assembly. In other words, said cup follows said cup support in all its movements, notwithstanding the degree of freedom in translation related to the damping function offered by the spring connection 20 provided between these two components.

Stops and/or mechanical connections, examples of which are mentioned above, prevent the cup 10 and its support 30 from becoming dissociated.

The invention claimed is:

1. A container for cosmetic product, comprising an assembly comprising a cup support and a cup, and a first body and a second body, the cup being configured to receive the cosmetic product, the cup being arranged in the cup support, the cup and the cup support being interconnected by a spring connection, the cup support configured to be arranged in an interior space of said first body, the cup support being movable relative to said first body, and the first body being arranged at least partially in an interior space of said second body, the second body being mounted in rotation relative to the first body, a rotation of the first body relative to the second body causing the cup support to move.

2. The container according to claim 1, wherein said cup and said cup support are mutually configured so that the cup is driven by the cup support.

3. The container according to claim 1, wherein the cup and the cup support are movable in translation relative to one another.

4. The container according to claim 1, wherein the cup and the cup support are fixed to one another for conjoint rotary movement.

5. The container according to claim 1, wherein one of the cup and the cup support is provided with a protrusion, the other of the cup and the cup support is provided with a guide, the protrusion and the guide being designed to cooperate with one another so as to allow the cup to slide relative to the cup support.

6. The container according to claim 1, said assembly comprising a spring, the spring connection being provided at least by said spring.

7. The container according to claim 6, wherein said spring is arranged between the cup and the cup support.

8. The container according to claim 6, wherein said spring is a helical spring.

9. The container according to claim 1, said assembly comprising flexible legs, said spring connection being provided at least by the flexible legs.

10. The container according to claim 1, wherein the cup is intended to receive a stick of the cosmetic product.

11. The container according to claim 10, wherein the cup support and the cup each comprise a bottom and said spring connection bears against each of said bottoms.

12. The container according to claim 1, wherein one of the first and the second bodies is provided with an axial guide, the other of said first and second bodies is provided with a helical guide, the cup support being provided with a protrusion intended to cooperate simultaneously with both the axial guide and the helical guide.

* * * * *